US009269329B2

(12) United States Patent
Jeong et al.

(10) Patent No.: US 9,269,329 B2
(45) Date of Patent: Feb. 23, 2016

(54) DISPLAY DEVICE, DATA PROCESSOR AND METHOD THEREOF

(71) Applicants: Geun-Young Jeong, Yongin (KR); Ji-Yeon Yang, Yongin (KR); Byung-Hyun Kim, Yongin (KR); Takeshi Kato, Yongin (KR); Myung-Ho Lee, Yongin (KR)

(72) Inventors: Geun-Young Jeong, Yongin (KR); Ji-Yeon Yang, Yongin (KR); Byung-Hyun Kim, Yongin (KR); Takeshi Kato, Yongin (KR); Myung-Ho Lee, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 295 days.

(21) Appl. No.: 13/924,696

(22) Filed: Jun. 24, 2013

(65) Prior Publication Data

US 2014/0232735 A1 Aug. 21, 2014

(30) Foreign Application Priority Data

Feb. 20, 2013 (KR) ..... 10-2013-0018171

(51) Int. Cl.

| | |
|---|---|
| ***G09G 5/04*** | (2006.01) |
| ***G09G 3/20*** | (2006.01) |
| *G09G 5/06* | (2006.01) |

(52) U.S. Cl.

CPC ..... *G09G 5/04* (2013.01); *G09G 3/2059* (2013.01); *G09G 5/06* (2013.01); *G09G 2300/0443* (2013.01); *G09G 2320/0276* (2013.01)

(58) Field of Classification Search

CPC ..... G09G 2320/0276; G09G 2320/0673; G09G 2340/0457; H04N 5/202; H04N 9/69; H04N 19/80; G06T 3/4015

See application file for complete search history.

(56) References Cited

U.S. PATENT DOCUMENTS

| | | | | |
|---|---|---|---|---|
| 5,821,913 | A * | 10/1998 | Mamiya | 345/88 |
| 2008/0247671 | A1* | 10/2008 | Yasuma | H04N 9/045 382/300 |
| 2012/0068205 | A1 | 3/2012 | Galvez et al. | |

FOREIGN PATENT DOCUMENTS

| | | | |
|---|---|---|---|
| KR | 10 2003-0031207 | A | 4/2003 |
| KR | 10 2003-0042603 | A | 6/2003 |
| KR | 10-0635507 | B1 | 10/2006 |
| KR | 10 2012-0027320 | A | 3/2012 |

* cited by examiner

*Primary Examiner* — Antonio A Caschera
(74) *Attorney, Agent, or Firm* — Lee & Morse, P.C.

(57) ABSTRACT

A data processor for a display device that includes a plurality of pixels, each of which includes red, first green, blue, and second green sub-pixels, may include an input gamma processor for processing image data including red, green, and blue grayscale data into linearized image data by applying a gamma function to the image data, a first sub-pixel rendering unit for rendering the linearized image data according to layout of a plurality of sub-pixels included in the plurality of pixels using a 3×1 rendering filter to output linearized second sub-pixel data, and an output gamma processor for processing the linearized second sub-pixel data into non-linearized second sub-pixel data by applying an inverse gamma function to the linearized second sub-pixel data.

24 Claims, 8 Drawing Sheets

DISPLAY DEVICE, DATA PROCESSOR AND METHOD THEREOF

CROSS-REFERENCE TO RELATED APPLICATION

This application claims priority to and the benefit of Korean Patent Application No. 10-2013-0018171, filed in the Korean Intellectual Property Office on Feb. 20, 2013, the entire contents of which are incorporated herein by reference.

BACKGROUND

1. Field

Embodiments relate to a display device, a data processor, and a method thereof.

2. Description of the Related Art

A display device may display images using a display panel designed in such a manner that one pixel includes three sub-pixels respectively expressing the colors of R (red), G (green), and B (blue).

The above information disclosed in this Background section is only for enhancement of understanding of the background of the art and therefore it may contain information that does not form the prior art that is already known in this country to a person of ordinary skill in the art.

SUMMARY

Embodiments are directed to a data processor for a display device that includes a plurality of pixels, each of which includes red, first green, blue, and second green sub-pixels, the data processor including an input gamma processor for processing image data including red, green, and blue grayscale data into linearized image data by applying a gamma function to the image data, a first sub-pixel rendering unit for rendering the linearized image data according to layout of a plurality of sub-pixels included in the plurality of pixels using a 3×1 rendering filter to output linearized second sub-pixel data, and an output gamma processor for processing the linearized second sub-pixel data into non-linearized second sub-pixel data by applying an inverse gamma function to the linearized second sub-pixel data.

The data processor may further include a second sub-pixel rendering unit for rendering the linearized image data according to the layout of the plurality of sub-pixels using a 3×1 rendering filter to output linearized first sub-pixel data.

The output gamma processor may non-linearize the linearized first sub-pixel data to output first sub-pixel data.

The first sub-pixel data and the second sub-pixel data may be grayscale data respectively corresponding to the plurality of sub-pixels The second sub-pixel rendering unit may include a 2-line buffer storing the linearized image data by every two rows, a first filter buffer storing first row partial data corresponding to three columns from among first row data stored in the 2-line buffer, a second filter buffer storing second row partial data corresponding to three columns from among second row data stored in the 2-line buffer, a third filter buffer storing third row partial data corresponding to three columns from among third row data following the second row data, and a 3×3 rendering filter for performing rendering by multiplying the first row partial data, the second row partial data, and the third row partial data by scale coefficients.

The second sub-pixel rendering unit may further include a memory interface for respectively transmitting the first row data, the second row data, and the third row data to the first filter buffer, the second filter buffer, and the third filter buffer.

The second sub-pixel rendering unit may further include a filter controller for selecting a type of the 3×3 rendering filter.

The first sub-pixel rendering unit may include a filter buffer storing the linearized image data and a 3×1 rendering filter performing rendering by multiplying data input thereto through the filter buffer by a scale coefficient.

The data input to the 3×1 rendering filter through the filter buffer may include reference data and two pieces of neighboring data adjacent to the reference data, and the 3×1 rendering filter may include a first scale coefficient multiplied by the reference data and a second scale coefficient multiplied by the two pieces of neighboring data.

The first scale coefficient may be 0.5 and the second coefficient may be 0.25.

The linearized second sub-pixel data may correspond to the sum of a product of the reference data and the first scale coefficient and products of the two pieces of neighboring data and the second scale coefficient.

The first sub-pixel rendering unit may further include a filter controller for selecting a type of the 3×1 rendering filter.

The data processor may further include an 8-color mode processor for matching the image data to the plurality of sub-pixels to output third sub-pixel data.

Embodiments are also directed to a data processing method for a display device that includes a plurality of pixels, each of which includes red, first green, blue, and second green sub-pixels, the data processing method including processing image data including red, green, and blue grayscale data into linearized image data by applying a gamma function to the image data; rendering the linearized image data using a 3×3 rendering filter to output linearized first sub-pixel data; rendering the linearized image data using a 3×1 rendering filter to output linearized second sub-pixel data; and applying an inverse gamma function to one of the linearized first sub-pixel data and linearized second sub-pixel data to output one of non-linearized first sub-pixel data and non-linearized second sub-pixel data, the outputting of the linearized first sub-pixel data and the output of the linearized second sub-pixel data being selectively performed.

The outputting of the linearized first sub-pixel data may include: storing the linearized image data in a 2-line buffer by every two rows; storing first row partial data corresponding to three columns from among first row data stored in the 2-line buffer; storing second row partial data corresponding to three columns from among second row data stored in the 2-line buffer; storing third row partial data corresponding to three columns from among third row data following the second row data; and performing rendering by multiplying the first row partial data, the second row partial data, and the third row partial data by scale coefficients of the 3×3 rendering filter.

The performing of rendering by multiplying the first row partial data, the second row partial data, and the third row partial data by the scale coefficients may include selecting a type of the 3×3 rendering filter.

The outputting of the linearized second sub-pixel data may include: storing the linearized image data in a filter buffer; and multiplying data input through the filter buffer by scale coefficients of the 3×1 rendering filter to render the data.

The multiplying of data input through the filter buffer by the scale coefficients of the 3×1 rendering filter to render the data may include: inputting reference data and two pieces of neighboring data adjacent to the reference data to the 3×1 rendering filter through the filter buffer; and generating the linearized second sub-pixel data from the sum of a product of the reference data and a first scale coefficient and products of the two pieces of neighboring data and a second scale coefficient.

The multiplying of data input through the filter buffer by the scale coefficients of the 3×1 rendering filter to render the data may include selecting a type of the 3×1 rendering filter.

Embodiments are also directed to a display device including a display unit including a plurality of pixels, each of which includes red, first green, blue, and second green sub-pixels, and a data processor for processing image data including red, green, and blue grayscale data into linearized image data by applying a gamma function to the image data, rendering the linearized image data according to layout of a plurality of sub-pixels included in the display unit using a 3×1 rendering filter to output linearized second sub-pixel data, and non-linearizing the linearized second sub-pixel data by applying an inverse gamma function to the linearized second sub-pixel data to generate sub-pixel data.

The data processor may apply the 3×1 rendering filter to image data corresponding to one of red and blue from among 3×1 image data included in the linearized image data to generate first sub-pixel data corresponding to the one of red and blue, and may apply the 3×1 rendering filter to image data corresponding to green from among the linearized 3×1 image data to generate second green sub-pixel data adjacent to the first sub-pixel data.

The data processor may include a filter buffer storing the linearized image data and a 3×1 rendering filter for multiplying data input through the filter buffer by a scale coefficient to render the data.

The data input to the 3×1 rendering filter through the filter buffer may include reference data representing one of red, green, and blue and two pieces of neighboring data adjacent to the reference data to express the same color, and the 3×1 rendering filter may include a first scale coefficient multiplied by the reference data and a second scale coefficient multiplied by the two pieces of neighboring data.

The first scale coefficient may be 0.5 and the second scale coefficient may be 0.25.

The data processor may generate the sub-pixel data from the sum of a product of the reference data and the first scale coefficient and products of the two pieces of neighboring data and the second scale coefficient.

The data processor may further include a filter controller for selecting a type of the 3×1 rendering filter.

BRIEF DESCRIPTION OF THE DRAWINGS

Features will become apparent to those of skill in the art by describing in detail example embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

Components having the same configuration in embodiments will be described using the same reference numbers in a first embodiment, and will be used throughout embodiments to refer to the same parts, and a first embodiment will be described and only parts different from those of the first embodiment will be explained in other embodiments.

For clarity of description, parts unrelated to the description may be omitted, and the same reference numbers will be used throughout this specification to refer to the same or like parts.

Throughout this specification and the claims that follow, when it is described that an element is "coupled" to another element, the element may be "directly coupled" to the other element or "electrically coupled" to the other element through a third element. In addition, unless explicitly described otherwise, the words "comprise" and variations such as "comprises" or "comprising," will be understood to imply the inclusion of stated elements but not the exclusion of any other elements.

Figure 1:
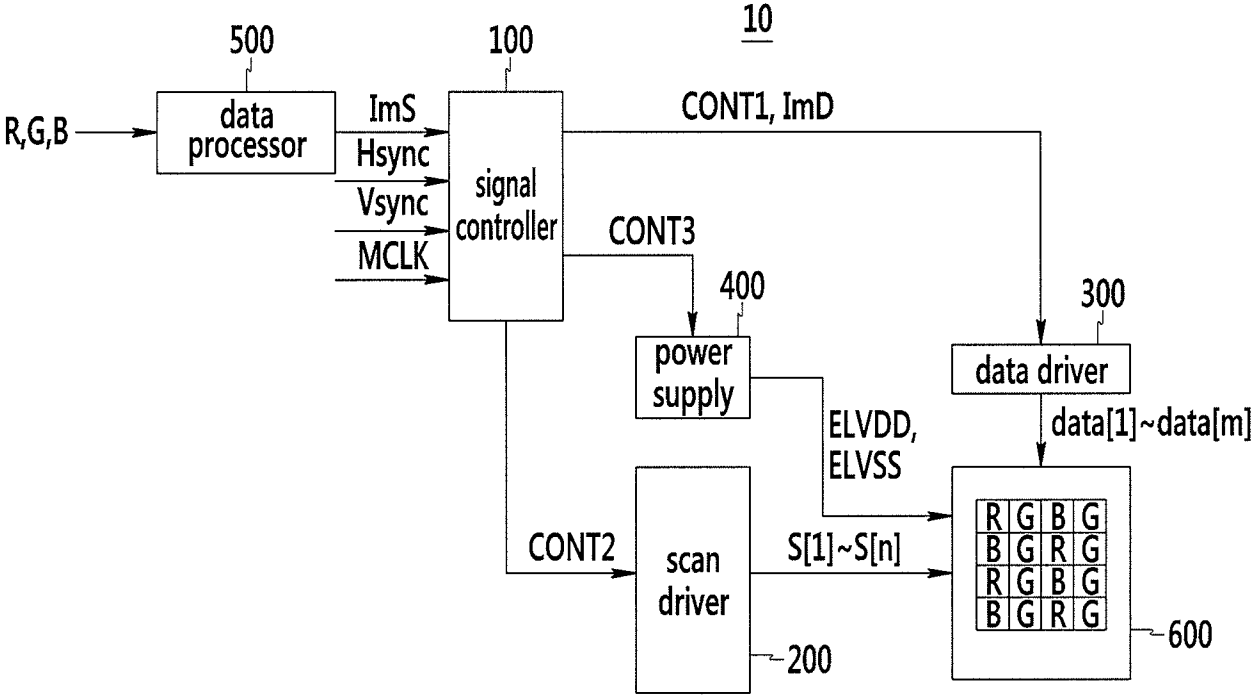
FIG. 1 is a block diagram of a display device according to an example embodiment.

FIG. 1 is a block diagram of a display device according to an example embodiment.

In the example embodiment shown in FIG. 1, a display device 10 includes a signal controller 100, a scan driver 200, a data driver 300, a power supply 400, a data processor 500, and a display unit 600.

The display unit 600 corresponds to a display area including a plurality of pixels. In the present example embodiment, each of the plurality of pixels has Pentile pixel structure. Thus, each of the plurality of pixels includes four sub-pixels of R (red), G (green), B (blue), and G (green). The display unit 600 is constructed in such a manner that a plurality of scan lines extended in a row direction in almost parallel, a plurality of data lines extended in a column direction in almost parallel, and a plurality of power lines are connected to a plurality of sub-pixels. The plurality of sub-pixels is arranged at intersections of the plurality of scan lines and the plurality of data lines in a matrix form.

The data processor 500 processes RGB image data R,G,B input from an external device into RGBG sub-pixel data ImS according to the layout of the plurality of sub-pixels to display an image using the display unit 600 having the Pentile pixel structure. The data processor 500 may render the RGB image data R,G,B into the RGBG sub-pixel data ImS according to one of a high-quality sub-pixel rendering (HQ-SPR) mode, a low-power sub-pixel rendering (LP-SPR) mode, and an 8-color mode. The RGBG sub-pixel data ImS is input to the signal controller 100.

The signal controller 100 receives the RGBG sub-pixel data ImS input from the data processor 500 and a synchronization signal input from an external device. The RGBG sub-pixel data ImS contains information on luminance of the plurality of sub-pixels. The luminance has a predetermined number of grayscales (grays), for example, 1024 ($=2^{10}$), 256 ($=2^8$) or 64 ($=2^6$) grayscales. The synchronization signal includes a horizontal synchronization signal Hsync, a vertical synchronization signal Vsync, and a main clock signal MCLK.

The signal controller 100 generates first, second, and third driving control signals CONT1, CONT2, and CONT3 and an image data signal ImD according to the RGBG sub-pixel data ImS, horizontal synchronization signal Hsync, vertical synchronization signal Vsync, and main clock signal MCLK.

The signal controller 100 divides the RGBG sub-pixel data ImS on a frame-by-frame basis according to the vertical synchronization signal Vsync and divides the RGBG sub-pixel data ImS on a scan line basis according to the horizontal synchronization signal Hsync to generate the image data signal ImD. The signal controller 100 transmits the image data signal ImD with the first driving control signal CONT1 to the data driver 300.

The scan driver 200 is connected to the plurality of scan lines and generates a plurality of scan signals S[1] to S[n] according to the second driving control signal CONT2. The scan driver 200 may sequentially apply the scan signals S[1] to S[n] corresponding to a gate-on voltage to the plurality of scan lines.

The data driver 300 is connected to the plurality of data lines, samples and holds the input image data signal ImD according to the first driving control signal CONT1, and respectively transmits a plurality of data signals data[1] to data[m] to the plurality of data lines. The data driver 300 applies data signals in a predetermined voltage range to the plurality of data lines in response to the scan signals S[1] to S[n] corresponding to the gate-on voltage.

The power supply 400 determines a first power source voltage ELVDD and a second power source voltage ELVSS according to the third driving control signal CONT3 and supplies the first and second power source voltages ELVDD and ELVSS to the power lines connected to the plurality of pixels. The first power source voltage ELVDD and the second power source voltage ELVSS provide pixel driving current.

Figure 2:
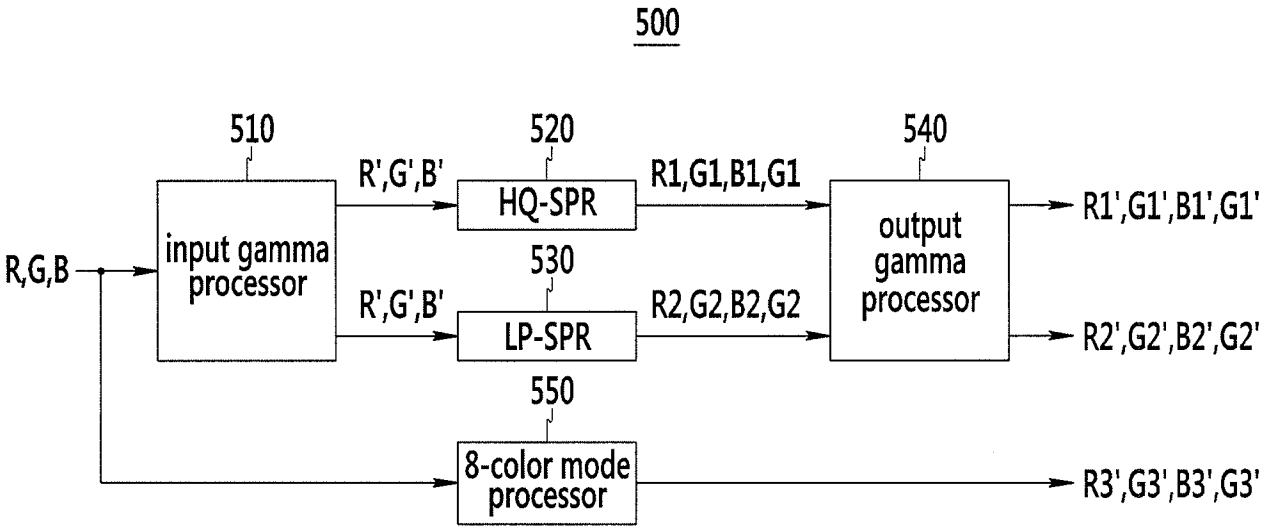
FIG. 2 is a block diagram of a data processor according to an example embodiment.

FIG. 2 is a block diagram of the data processor according to an example embodiment.

Referring to FIG. 2, the data processor 500 includes an input gamma processor 510, a high-quality sub-pixel rendering unit (hereinafter, referred to as HQ-SPR) 520, a low-power sub-pixel rendering unit (hereinafter, referred to as LP-SPR) 530, an output gamma processor 540, and an 8-color mode processor 550.

The input gamma processor 510 linearizes the RGB image data R,G,B by applying a gamma function to the RGB image data R,G,B. The RGB image data R,G,B is grayscale data of R, G, and B and has a nonlinear characteristic, and thus it may be difficult to render the RGB image data in terms of hardware configuration. Thus, the input gamma processor 510 processes the RGB image data R,G,B into linearized RGB image data R',G',B'.

For example, the input gamma processor 510 may apply a gamma function ($f=x^{2.2}$) that multiplies the RGB image data R,G,B by a reference gamma value (e.g., 2.2) to generate the linearized RGB image data R',G',B'. The linearized RGB image data R',G',B' is transmitted to the HQ-SPR 520 and LP-SPR 530.

The HQ-SPR 520 renders the linearized RGB image data R',G',B' into first RGBG sub-pixel data R1,G1,B1,G1 suitable for the layout of the sub-pixels. The HQ-SPR 520 performs rendering using a 3×3 rendering filter. The linearized first RGBG sub-pixel data R1,G1,B1,G1 is input to the output gamma processor 540.

The LP-SPR 530 renders the linearized RGB image data R',G',B' into second RGBG sub-pixel data R2,G2,B2,G2 suitable for the layout of the sub-pixels. The LP-SPR 530 performs rendering using a 3×1 rendering filter. The linearized second RGBG sub-pixel data R2, G2, B2, G2 is applied to the output gamma processor 540.

The output gamma processor 540 non-linearizes the linearized first RGBG sub-pixel data R1,G1,B1,G1 by applying an inverse gamma function ($f=x^{1/2.2}$) to the linearized first RGBG sub-pixel data R1,G1,B1,G1 to generate first RGBG sub-pixel data R1',G1',B1',G1'.

In addition, the output gamma processor 540 non-linearizes the linearized second RGBG sub-pixel data R2,G2,B2, G2 by applying the inverse gamma function ($f=x^{1/2.2}$) thereto to generate second RGBG sub-pixel data R2',G2',B2',G2'. The first RGBG sub-pixel data R1',G1',B1',G1' and the second RGBG sub-pixel data R2',G2',B2',G2 are grayscale data respectively corresponding to a plurality of sub-pixels arranged in the Pentile structure.

The 8-color mode processor 550 matches the RGB image data R,G,B to the plurality of sub-pixels in Pentile structure without performing rendering, to output third RGBG sub-pixel data R3',G3',B3',G3'. The third RGBG sub-pixel data R3',G3',B3',G3' limits colors of displayed images to 8 colors.

The data processor 500 is not limited to the above-described configuration and may further include an edge processor for processing edge data and a dithering unit having a dithering function, etc.

In the present example embodiment, one of the HQ-SPR 520, the LP-SPR 530, and the 8-color mode processor 550 may be selectively operated according to user selection or driving condition of the display device. Thus, the HQ-SPR 520 may be operated according to the high-quality sub-pixel rending mode to process the RGB image data R,G,B into the first RGBG sub-pixel data R1',G1',B1',G1'. Otherwise, the LP-SPR 530 may be operated according to the low-power sub-pixel rendering mode to process the RGB image data R,G,B into the second RGBG sub-pixel data R2',G2',B2',G2'. Furthermore, the RGB image data R,G,B may be processed into the third RGBG sub-pixel data R3',G3',B3',G3' according to the 8-color mode and output.

A description will now be given of rendering performed by the HQ-SPR 520 according to the high-quality sub-pixel rendering mode with reference to FIGS. 3 to 5.

Figure 3:
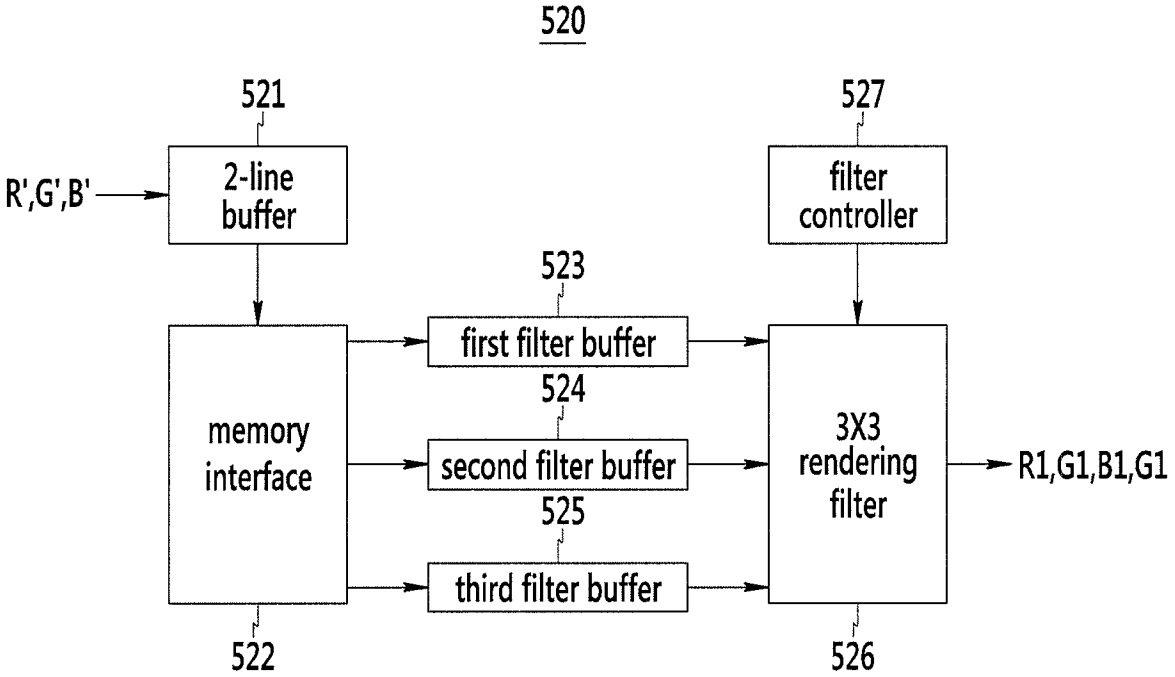
FIG. 3 is a block diagram of a high-quality sub-pixel rendering device according to an example embodiment.

FIG. 3 is a block diagram of the HQ-SPR 520 according to an example embodiment.

In the example embodiment shown in FIG. 3, the HQ-SPR 520 includes a 2-line buffer 521, a memory interface 522, a first filter buffer 523, a second filter buffer 524, a third filter buffer 525, a 3×3 rendering filter 526, and a filter controller 527.

The 2-line buffer 521 stores the RGB image data R',G',B' linearized by the input gamma processor 510. The 2-line buffer 521 stores the linearized RGB image data R',G',B' by two columns because the 3×3 rendering filter 526 performs rendering using data corresponding to three columns. For example, the 2-line buffer 521 stores data corresponding to first and second columns until data corresponding to the third column is input thereto.

The memory interface 522 receives data suitable for rendering through the 3×3 rendering filter 526 from the 2-line buffer 521. Specifically, the memory interface 522 transmits the first-column data stored in the 2-line buffer 521 to the first filter buffer 523 and the second-column data stored in the 2-line buffer 521 to the second filter buffer 524. The memory interface 522 delivers the third-column data input to the 2-line buffer 521 to the third filter buffer 525.

The first filter buffer 523 stores partial data of the first column, which has a size suitable for rending through the 3×3 rendering filter 526, from among the first-column data stored in the 2-line buffer 521. The partial data of the first column is data suitable for rending through the 3×3 rendering filter 526 and may have a size of three columns corresponding to three pixels from among the first-column data stored in the 2-line buffer 521.

The second filter buffer 524 stores partial data of the second column, which has a size suitable for rending through the 3×3 rendering filter 526, from among the second-column data stored in the 2-line buffer 521. The partial data of the second column is data suitable for rending through the 3×3 rendering filter 526 and may have a size of three columns corresponding to three pixels from among the second-column data stored in the 2-line buffer 521.

The third filter buffer 525 stores partial data of the third column, which has a size suitable for rending through the 3×3 rendering filter 526, from among the third-column data following the second-column data, stored in the 2-line buffer 521. The partial data of the third column is data suitable for rending through the 3×3 rendering filter 526 and may have a size of three columns corresponding to three pixels from among the third-column data stored in the 2-line buffer 521.

Data corresponding to three columns and three rows may be input to the 3×3 rendering filter 526 through the first filter buffer 523, the second filter buffer 524, and the third filter buffer 525.

The 3×3 rendering filter 526 renders the data corresponding to three columns and three rows, i.e., the partial data of the first, second, and third columns input through the first filter buffer 523, the second filter buffer 524, and the third filter buffer 525, by applying a scale coefficient thereto. Thus, the data stored in the first filter buffer 523, the second filter buffer 524, and the third filter buffer 525 passes through 3×3 rendering filter 526 to be output as the linearized first RGBG sub-pixel data R1,G1,B1,G1.

The filter controller 527 selects a type of the 3×3 rendering filter 526. Various types of the 3×3 rendering filter 526 may be determined, and thus various rendering results may be determined. FIGS. 4 and 5 illustrate rendering processes according to different types of the 3×3 rendering filter 526.

Figure 4:
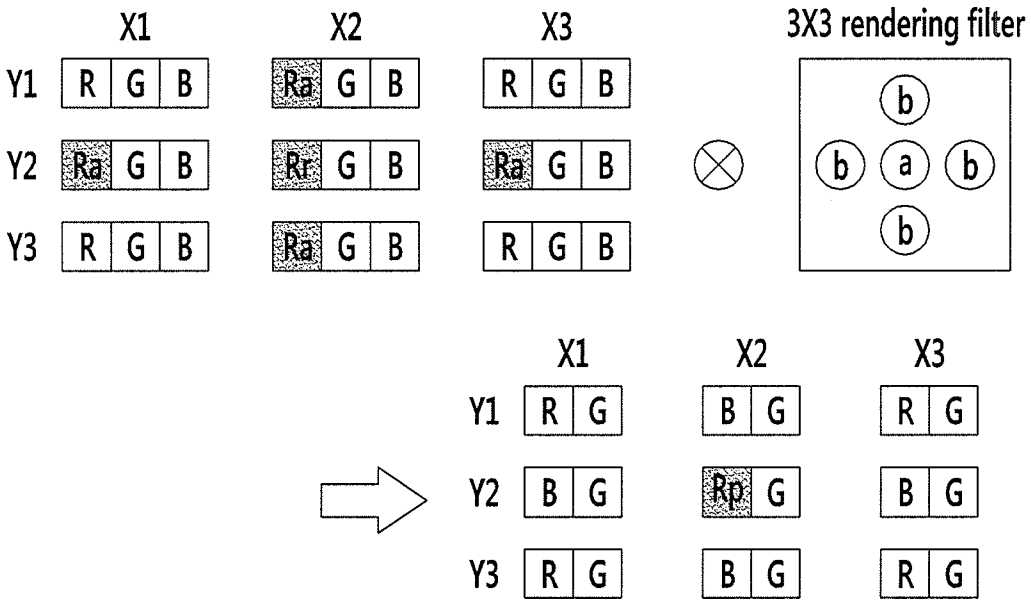
FIG. 4 illustrates a rendering process performed by a high-quality sub-pixel rendering device according to an example embodiment.

FIG. 4 illustrates a rendering process in a high-quality sub-pixel rendering device according to an example embodiment. Here, 3×3 pixels are represented in (X, Y) coordinates, corresponding to a 3×3 rendering filter.

In the example embodiment shown in FIG. 4, the 3×3 rendering filter 526 is a D filter. The D filter is a basic rendering filter and diffuses red and blue in all directions such that a blurred image is displayed.

The D filter designates scale coefficients a and b to five regions. The sum of the scale coefficients a and b designated to the five regions may be set to 1. For example, a=0.5 and b=0.125.

As shown in FIG. 4, reference R data Rr and neighboring four R data Ra, included in pixels of (X2, Y2) coordinates, pass through the D filter to be rendered into R sub-pixel data Rp corresponding to an R sub-pixel in Pentile structure. The reference R data Rr and neighboring four R data Ra are respectively multiplied by scale coefficients corresponding thereto and the sum of the multiplication results is calculated as a rendering value of the reference R data Rr, i.e., the R sub-pixel data Rp. In this manner, B data may also be rendered into B sub-pixel data having the Pentile structure. Furthermore, G data may also be rendered into G sub-pixel data having the Pentile structure.

Figure 5:
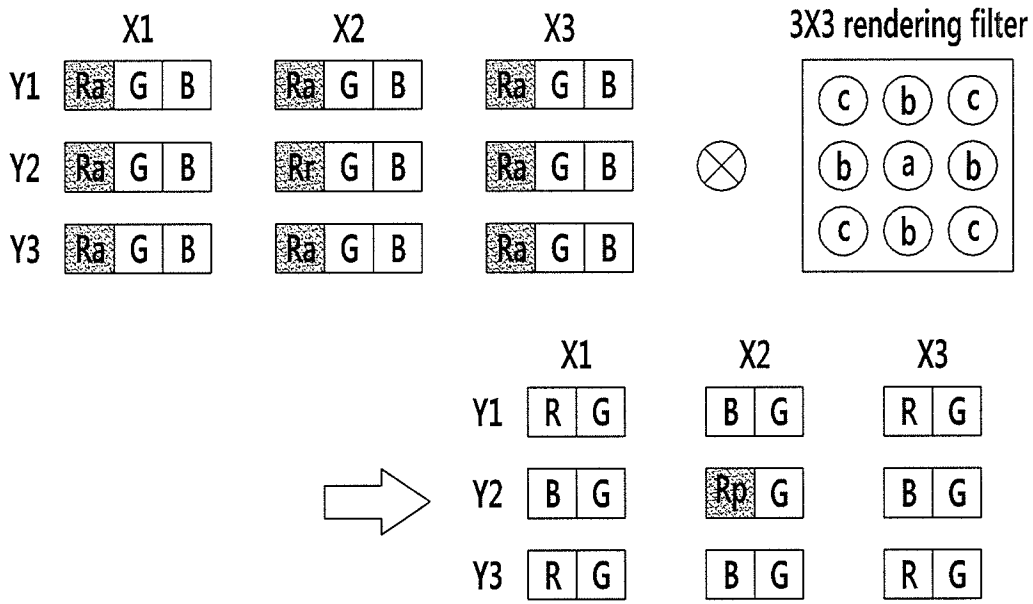
FIG. 5 illustrates a rendering process performed by a high-quality sub-pixel rendering device according to another example embodiment.

FIG. 5 illustrates a rendering process in a high-quality sub-pixel rendering device according to another example embodiment. Here, 3×3 pixels are represented in (X, Y) coordinates, corresponding to the 3×3 rendering filter 526.

In the example embodiment shown in FIG. 5, the 3×3 rendering filter 526 corresponds to a DS filter. The DS filter concentrates luminance on pixel positions corresponding to RGB image data R,G,B to emphasize sharpness.

The DS filter designates scale coefficients a, b, and c to nine regions. The sum of the scale coefficients a, b, and c set to the nine regions may be set as 1. For example, a=0.75, b=0.125, and c=−0.0625.

As shown in FIG. 5, reference R data Rr and neighboring eight R data Ra, included in pixels of (X2, Y2) coordinates, pass through the DS filter to be rendered into R sub-pixel data Rp corresponding to the R sub-pixel having the Pentile structure. The reference R data Rr and neighboring eight R data Ra are respectively multiplied by scale coefficients corresponding thereto and the sum of the multiplication results is calculated as a rendering value of the reference R data Rr, i.e., the R sub-pixel data Rp. In this manner, B data may also be rendered into B sub-pixel data having the Pentile structure. Furthermore, G data may also be rendered into G sub-pixel data having the Pentile structure.

A description will now be given of rendering according to the LP-SPR 530 in the low-power sub-pixel rendering mode with reference to FIGS. 6 and 7.

Figure 6:
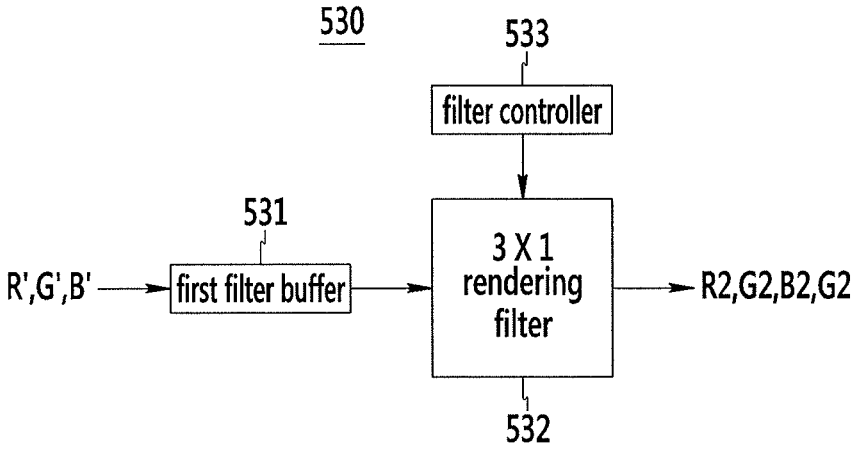
FIG. 6 is a block diagram of a low-power sub-pixel rendering device according to an example embodiment.

FIG. 6 is a block diagram of the LP-SPR 530 according to an example embodiment.

In the example embodiment shown in FIG. 6, the LP-SPR 530 includes a first filter buffer 531, a 3×1 rendering filter 532, and a filter controller 533.

The first filter buffer 531 stores RGB image data R',G',B' linearized by the input gamma processor 510. The first filter buffer 531 may store the linearized RGB image data R',G',B' row by row.

The 3×1 rendering filter 532 performs rendering by multiplying data input through the first filter buffer 531 by a scale coefficient. Thus, data stored in the first filter buffer 531 passes through the 3×1 rendering filter 532 to be output as linearized second RGBG sub-pixel data R2,G2,B2,G2.

The filter controller 533 selects a type of the 3×1 rendering filter 532.

Figure 7:
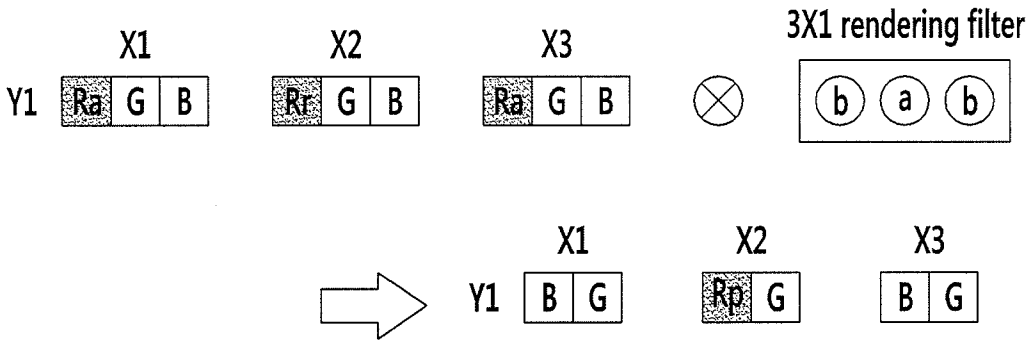
FIG. 7 illustrates a rendering process performed by a low-power sub-pixel rendering device according to an example embodiment.

FIG. 7 illustrates a rendering process in the LP-SPR according to an example embodiment.

In the example embodiment shown in FIG. 7, the 3×1 rendering filter corresponds to an S filter. The S filter applies diffusion only in a row direction such that a line in the row direction is represented with the best sharpness and a line in a column direction is displayed as a clear image although it is thickened.

The S filter designates scale coefficients a and b to three regions. The sum of the scale coefficients a and b set to the three regions may be set as 1. For example, a=0.5 and b=0.25.

As shown in FIG. 7, reference R data Rr and neighboring two R data Ra, included in pixels of (X2, Y2) coordinates, pass through the S filter to be rendered into R sub-pixel data Rp corresponding to the R sub-pixel having the Pentile structure. The reference R data Rr and neighboring two R data Ra are respectively multiplied by scale coefficients corresponding thereto and the sum of the multiplication results is calculated as a rendering value of the reference R data Rr, i.e., the R sub-pixel data Rp. In this manner, B data may also be rendered into B sub-pixel data having the Pentile structure. Furthermore, G data may also be rendered into G sub-pixel data having the Pentile structure.

As described above, the 3×1 rendering filter is applied to image data R and B from among 3×1 image data to generate first sub-pixel data corresponding to R or B, and the 3×1 rendering filter is applied to image data G from among the 3×1 image data to generate second sub-pixel data corresponding to G, adjacent to the first sub-pixel.

Power consumed by the data processor 500 when the data processor 500 is operated in the high-quality sub-pixel rendering mode, the low-power sub-pixel rendering mode, and the 8-color mode will now be compared.

According to an example embodiment, when the data processor 500 is operated in the high-quality sub-pixel rendering mode, power consumption of the input gamma processor 510 corresponds to about 6% of power consumption of the data processor 500, power consumption of the HQ-SPR 520 corresponds to about 65%, power consumption of the output gamma processor 540 corresponds to about 10%, and power consumption of an edge processing or dithering unit corresponds to about 19%. Thus, the HQ-SPR 520 consumes a relatively large amount of power of the data processor 500.

The 8-color mode processor 550 does not perform rendering, and thus power consumption thereof is ignorable. However, since images are displayed only in 8 colors in the 8-color mode, expression and image quality may be deteriorated. Accordingly, the 8-color mode may be limited to use for a black-and-white image such as an idle screen or an image representing a simple pattern.

The LP-SPR 530 uses the 3×1 rendering filter 532, and thus the LP-SPR 530 may store only data corresponding to one row. Accordingly, the LP-SPR 530 may not include the 2-line buffer 521 storing data of two rows and may not use the memory interface 522, second filter buffer 524, and third filter buffer 525 for distributing data of three rows to respective rows. Accordingly, the LP-SPR 530 may be simplified into a pixel-based simple pipeline and a parallel multiplier. The 3×1 rendering filter 532 has a scale coefficient corresponding to a negative multiple of 2, such as ½, ¼, etc., and thus the LP-SPR 530 may be implemented by a simple shift operation and addition without including a multiplier.

Accordingly, the LP-SPR 530 may significantly reduce a computational load and buffer memory. Furthermore, the LP-SPR 530 may be simplified such that a controller and interconnection for memory input/output may be removed, as compared to the HQ-SPR 520, and may perform rendering through the simple pipeline and significantly decrease power consumption for rendering.

Figure 8:
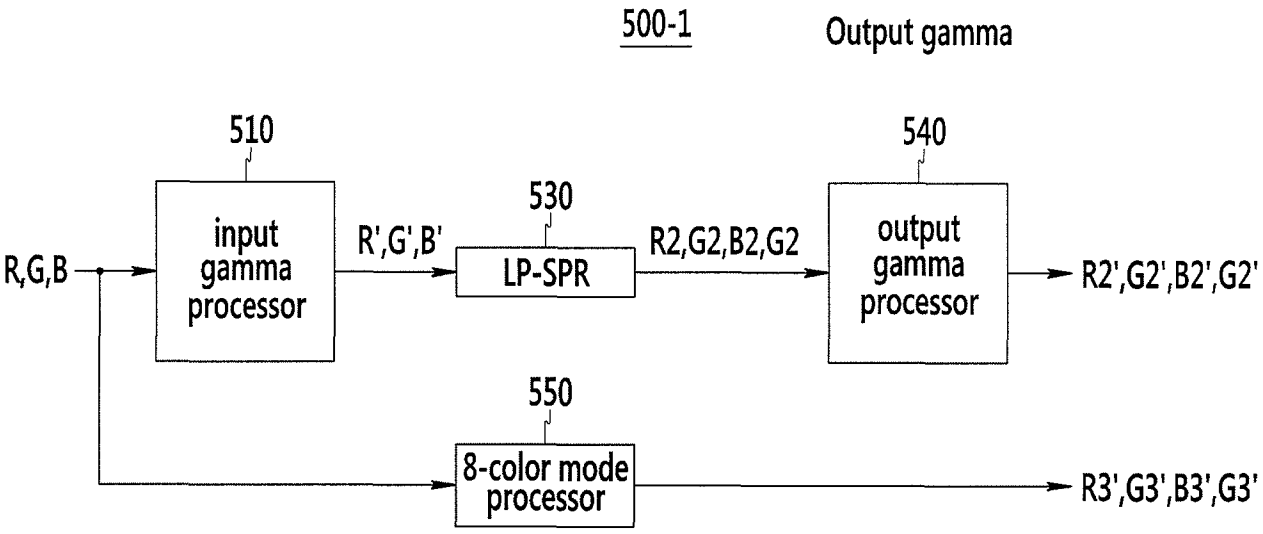
FIG. 8 is a block diagram of a data processor according to another example embodiment.

FIG. 8 is a block diagram of a data processor according to another example embodiment.

In the example embodiment shown in FIG. 8, a data processor 500-1 according to a second example embodiment includes the input gamma processor 510, LP-SPR 530, output gamma processor 540, and 8-color mode processor 550. Thus, the configuration of the data processor 500-1 according to the second example embodiment corresponds to that of the data processor 500 shown in FIG. 2, except that the HQ-SPR 520 is excluded from the configuration of the data processor 500-1. The data processor 500-1 according to the second example embodiment is operated in one of the low-power sub-pixel rendering mode and the 8-color mode.

Since operations of components included in the data processor 500-1 according to the second example embodiment correspond to those described in FIG. 2, description thereof is omitted.

By way of summation and review, a Pentile technology may be considered to implement six sub-pixels respectively expressing R, G, B, R, G, and B with four sub-pixels respectively representing R, G, B, and G. Regarding the resolution of a display device employing Pentile, as the number of sub-pixels decreases, reduced resolution may be compensated for using a rendering module for rending RGB image data into RGBG sub-pixel data. When Pentile technology is applied to manufacture of display devices, a high-resolution high-definition display device may be produced, and high-precision micropatterning and microdeposition technology may not be needed. A display device employing Pentile technology may consume more power and emit more heat as the resolution thereof increases to beyond HD (High Definition).

As described above, embodiments relate to a display device that may be driven with low power, a data processor, and a method thereof. Embodiments may provide a display device, a data processing apparatus, and a method thereof that may reduce power consumption of a display device having a Pentile pixel structure. In the display device having a pentile pixel structure, power consumed for rendering may be reduced and heat radiation of the display device may be decreased. Furthermore, mobile device use time may be increased.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A data processor for a display device that includes a plurality of pixels, each of which includes red, first green, blue, and second green sub-pixels, the data processor comprising:

an input gamma processor for processing image data including red, green, and blue grayscale data into linearized image data by applying a gamma function to the image data;

a first sub-pixel rendering unit for rendering the linearized image data according to a layout of a plurality of sub-pixels included in the plurality of pixels using a 3×1 rendering filter to output linearized second sub-pixel data;

an output gamma processor for processing the linearized second sub-pixel data into non-linearized second sub-pixel data by applying an inverse gamma function to the linearized second sub-pixel data; and a second sub-pixel rendering unit for rendering the linearized image data according to the layout of the plurality of sub-pixels using a 3×3 rendering filter to output linearized first sub-pixel data.

2. The data processor of claim 1, wherein the output gamma processor non-linearizes the linearized first sub-pixel data to output first sub-pixel data.

3. The data processor of claim 1, wherein the first sub-pixel data and the second sub-pixel data are grayscale data respectively corresponding to the plurality of sub-pixels.

4. The data processor of claim 1, wherein the second sub-pixel rendering unit includes:

a 2-line buffer storing the linearized image data by every two rows;

a first filter buffer storing first row partial data corresponding to three columns from among first row data stored in the 2-line buffer;

a second filter buffer storing second row partial data corresponding to three columns from among second row data stored in the 2-line buffer;

a third filter buffer storing third row partial data corresponding to three columns from among third row data following the second row data; and a 3×3 rendering filter for performing rendering by multiplying the first row partial data, the second row partial data, and the third row partial data by scale coefficients.

5. The data processor of claim 4, wherein the second sub-pixel rendering unit further includes a memory interface for respectively transmitting the first row data, the second row data, and the third row data to the first filter buffer, the second filter buffer, and the third filter buffer.

6. The data processor of claim 4, wherein the second sub-pixel rendering unit further includes a filter controller for selecting a type of the 3×3 rendering filter.

7. The data processor of claim 1, wherein the first sub-pixel rendering unit includes:

a filter buffer storing the linearized image data; and a 3×1 rendering filter performing rendering by multiplying data input thereto through the filter buffer by a scale coefficient.

8. The data processor of claim 7, wherein the data input to the 3×1 rendering filter through the filter buffer includes reference data and two pieces of neighboring data adjacent to the reference data, and the 3×1 rendering filter includes a first scale coefficient multiplied by the reference data and a second scale coefficient multiplied by the two pieces of neighboring data.

9. The data processor of claim 8, wherein the first scale coefficient is 0.5 and the second coefficient is 0.25.

10. The data processor of claim 8, wherein the linearized second sub-pixel data corresponds to the sum of a product of the reference data and the first scale coefficient and products of the two pieces of neighboring data and the second scale coefficient.

11. The data processor of claim 7, wherein the first sub-pixel rendering unit further includes a filter controller for selecting a type of the 3×1 rendering filter.

12. The data processor of claim 1, further comprising an 8-color mode processor for matching the image data to the plurality of sub-pixels to output third sub-pixel data.

13. A data processing method for a display device that includes a data processor, a signal controller, and a plurality of pixels, each of which includes red, first green, blue, and second green sub-pixels, the data processing method comprising operating the data processor of the display device to:

process image data including red, green, and blue grayscale data into linearized image data by applying a gamma function to the image data;

render the linearized image data using a 3×3 rendering filter to output linearized first sub-pixel data;

render the linearized image data using a 3×1 rendering filter to output linearized second sub-pixel data; and apply an inverse gamma function to one of the linearized first sub-pixel data and linearized second sub-pixel data to output one of non-linearized first sub-pixel data and non-linearized second sub-pixel data to the signal controller, the outputting of the linearized first sub-pixel data and the output of the linearized second sub-pixel data being selectively performed.

14. The data processing method of claim 13, wherein the outputting of the linearized first sub-pixel data includes:

storing the linearized image data in a 2-line buffer by every two rows;

storing first row partial data corresponding to three columns from among first row data stored in the 2-line buffer;

storing second row partial data corresponding to three columns from among second row data stored in the 2-line buffer;

storing third row partial data corresponding to three columns from among third row data following the second row data; and performing rendering by multiplying the first row partial data, the second row partial data, and the third row partial data by scale coefficients of the 3×3 rendering filter.

15. The data processing method of claim 14, wherein the performing of rendering by multiplying the first row partial data, the second row partial data, and the third row partial data by the scale coefficients includes selecting a type of the 3×3 rendering filter.

16. The data processing method of claim 13, wherein the outputting of the linearized second sub-pixel data includes:

storing the linearized image data in a filter buffer; and multiplying data input through the filter buffer by scale coefficients of the 3×1 rendering filter to render the data.

17. The data processing method of claim 16, wherein the multiplying of data input through the filter buffer by the scale coefficients of the 3×1 rendering filter to render the data includes:

inputting reference data and two pieces of neighboring data adjacent to the reference data to the 3×1 rendering filter through the filter buffer; and generating the linearized second sub-pixel data from the sum of a product of the reference data and a first scale coefficient and products of the two pieces of neighboring data and a second scale coefficient.

18. The data processing method of claim 16, wherein the multiplying of data input through the filter buffer by the scale coefficients of the 3×1 rendering filter to render the data includes selecting a type of the 3×1 rendering filter.

19. A display device, comprising:

a display unit including a plurality of pixels, each of which includes red, first green, blue, and second green sub-pixels; and a data processor for processing image data including red, green, and blue grayscale data into linearized image data by applying a gamma function to the image data, rendering the linearized image data according to a layout of a plurality of sub-pixels included in the display unit using a 3×1 rendering filter to output linearized second sub-pixel data, and non-linearizing the linearized second sub-pixel data by applying an inverse gamma function to the linearized second sub-pixel data to generate sub-pixel data, wherein the data processor applies the 3×1 rendering filter to image data corresponding to one of red and blue from among 3×1 image data included in the linearized image data to generate first sub-pixel data corresponding to the one of red and blue, and applies the 3×1 rendering filter to image data corresponding to green from among the linearized 3×1 image data to generate second green sub-pixel data adjacent to the first sub-pixel data.

20. The display device of claim 19, wherein the data processor includes:

a filter buffer storing the linearized image data; and a 3×1 rendering filter for multiplying data input through the filter buffer by a scale coefficient to render the data.

21. The display device of claim 20, wherein the data input to the 3×1 rendering filter through the filter buffer includes reference data representing one of red, green, and blue and two pieces of neighboring data adjacent to the reference data to express the same color, and the 3×1 rendering filter includes a first scale coefficient multiplied by the reference data and a second scale coefficient multiplied by the two pieces of neighboring data.

22. The display device of claim 21, wherein the first scale coefficient is 0.5 and the second scale coefficient is 0.25.

23. The display device of claim 21, wherein the data processor generates the sub-pixel data from the sum of a product of the reference data and the first scale coefficient and products of the two pieces of neighboring data and the second scale coefficient.

24. The display device of claim 20, wherein the data processor further includes a filter controller for selecting a type of the 3×1 rendering filter.

* * * * *